US010407744B2

(12) United States Patent
O et al.

(10) Patent No.: US 10,407,744 B2
(45) Date of Patent: Sep. 10, 2019

(54) PRODUCTION METHOD OF GRANULAR METALLIC IRON

(71) Applicant: KOBE STEEL, LTD., Kobe-shi (JP)

(72) Inventors: Shorin O, Hyogo (JP); Shuzo Ito, Hyogo (JP)

(73) Assignee: Kobe Steel, Ltd., Kobe-shi (JP)

( * ) Notice: Subject to any disclaimer, the term of this patent is extended or adjusted under 35 U.S.C. 154(b) by 280 days.

(21) Appl. No.: 15/310,483

(22) PCT Filed: May 13, 2015

(86) PCT No.: PCT/JP2015/063755
§ 371 (c)(1),
(2) Date: Nov. 11, 2016

(87) PCT Pub. No.: WO2015/174450
PCT Pub. Date: Nov. 19, 2015

(65) Prior Publication Data

US 2017/0073781 A1 Mar. 16, 2017

(30) Foreign Application Priority Data

May 15, 2014 (JP) ..... 2014-101724

(51) Int. Cl.
*C21B 13/10* (2006.01)
*C21B 13/00* (2006.01)
(Continued)

(52) U.S. Cl.
CPC ..... *C21B 13/0053* (2013.01); *C21B 11/08* (2013.01); *C21B 11/10* (2013.01);
(Continued)

(58) Field of Classification Search
None
See application file for complete search history.

(56) References Cited

U.S. PATENT DOCUMENTS 4,247,323 A * 1/1981 Serbent ..... C21B 13/08 75/474
6,171,364 B1 * 1/2001 Sarma ..... C21B 13/0006 75/382
(Continued)

FOREIGN PATENT DOCUMENTS

CN 102559977 A 7/2012
JP 2002-30319 A 1/2002
(Continued)

OTHER PUBLICATIONS

International Search Report dated Aug. 4, 2015 in PCT/JP2015/063755 (with English language translation).
(Continued)

*Primary Examiner* — George Wyszomierski
(74) *Attorney, Agent, or Firm* — Oblon, McClelland, Maier & Neustadt, L.L.P.

(57) ABSTRACT

This method is for producing granular metallic iron in which the relation between the mass ratio (mass %) of the volatile matter content contained in a carbonaceous reducing agent and the average gas flow rate (m/s) of the ambient gas in a heating furnace fulfills expression (1). Mass ratio of volatile matter content≤−4.62×average gas flow rate+46.7 . . . (1)

4 Claims, 5 Drawing Sheets

(51) Int. Cl.

| | |
|---|---|
| ***C21B 11/08*** | (2006.01) |
| ***C21B 11/10*** | (2006.01) |
| ***C21B 13/12*** | (2006.01) |
| ***C22B 1/24*** | (2006.01) |
| ***C22B 1/245*** | (2006.01) |

(52) U.S. Cl.
CPC ..... *C21B 13/0066* (2013.01); *C21B 13/105* (2013.01); *C21B 13/12* (2013.01); *C22B 1/24* (2013.01); *C22B 1/245* (2013.01); *C21B 2300/02* (2013.01)

(56) References Cited

U.S. PATENT DOCUMENTS

| | | | |
|---|---|---|---|
| 6,592,649 | B2 | 7/2003 | Kikuchi et al. |
| 8,377,169 | B2 | 2/2013 | Tokuda et al. |
| 8,617,459 | B2 | 12/2013 | Tokuda et al. |
| 2002/0033075 | A1 | 3/2002 | Kikuchi et al. |
| 2010/0313710 | A1 | 12/2010 | Tokuda et al. |
| 2011/0024681 | A1 | 2/2011 | Sugiyama et al. |
| 2011/0265603 | A1 | 11/2011 | Sugiyama et al. |
| 2012/0006449 | A1 | 1/2012 | Mitsutaka et al. |
| 2012/0205840 | A1 | 8/2012 | Tokuda et al. |
| 2012/0279353 | A1* | 11/2012 | Englund ..... C21B 13/10 75/380 |
| 2013/0098204 | A1 | 4/2013 | Misawa et al. |

FOREIGN PATENT DOCUMENTS

| | | | |
|---|---|---|---|
| JP | 2008-121085 | A | 5/2008 |
| JP | 2009-270198 | A | 11/2009 |
| JP | 2010-189762 | A | 9/2010 |
| JP | 2010-261101 | A | 11/2010 |
| RU | 2 529 435 | C1 | 9/2014 |

OTHER PUBLICATIONS

Written Opinion dated Aug. 4, 2015 in PCT/JP2015/063755 (with English language translation).

* cited by examiner

PRODUCTION METHOD OF GRANULAR METALLIC IRON

TECHNICAL FIELD

The present invention relates to a method for producing granular metallic iron by agglomerating a mixture including an iron oxide-containing material and a carbonaceous reducing agent, charging a resulting agglomerate onto a hearth of a heating furnace and heating it, thereby reducing iron oxide in the agglomerate, and melting reduced iron by further heating to cause the reduced iron to coalesce.

BACKGROUND ART

A blast furnace-converter process has been known as an iron-making process using iron ore as a raw material. The blast furnace converter process is a process of producing steel by reducing iron ore in a blast furnace to produce molten iron containing carbon in high concentration, and decarburizing the molten iron in a converter. The above blast furnace-converter process requires preliminary treatment of raw materials such as coke and sintered ore. Further, in recent years, it has a tendency to become large in scale in order to enjoy a scale merit, which reduces flexibility or productivity to resources. Further, from the viewpoint of natural environmental protection, an iron-making process for reducing $CO_2$ gas emissions is desired. However, the above blast furnace-converter process is a so-called indirect iron-making process, so that it has a problem that the $CO_2$ gas emissions are large compared to a direct iron-making process in which steel is directly produced by reducing iron ore. For this reason, in recent years, the direct iron-making process is recognized once again.

As the above direct iron-making process, for example, a MIDREX process has been known. In the MIDREX process, a large amount of natural gas is used as a reducing agent for reducing iron ore. For this reason, there has been a drawback that a location place of a plant is limited to a production area of natural gas.

Therefore, a process using easily available coal as a reducing agent instead of the natural gas has recently attracted attention. In this process, granular metallic iron is produced by charging an agglomerate including an iron oxide-containing material such as iron ore and a carbonaceous reducing agent such as coal onto a hearth of a heating furnace such as a movable hearth furnace, reducing iron oxide in the agglomerate by heating due to gas heat transfer or radiant heat from heating burners in the furnace, and melting reduced iron by further heating to cause the reduced iron to coalesce. This process has advantages that high-speed reduction becomes possible because powdery iron ore can be used as it is and the iron core and the reducing agent are closely arranged, and that the carbon content in a product can be adjusted by a method such as adjustment of the blending amount of the reducing agent.

In producing granular metallic iron in a movable hearth type thermal reduction furnace, the present inventors disclose technology of Patent Document 1 as a method which can produce high-quality granular metallic iron having a high C amount and a low S amount. In this technology, the flow rate of atmospheric gas in the furnace is controlled, in producing the granular metallic iron by charging an raw material mixture including an iron oxide-containing material and a carbonaceous reducing agent onto a hearth of a movable hearth type thermal reduction furnace and heating it, reducing iron oxide in the raw material mixture with the carbonaceous reducing agent, melting metallic iron produced, causing the metallic iron melted to coalesce into granules while separating it from slag formed as a by-product, and then, cooling and solidifying it. Specifically, the average flow rate of the atmospheric gas in the furnace is controlled to 5 m/sec or less, and this flow rate control is performed at least between an end stage of reduction and completion of melting of the metallic iron.

PRIOR ART DOCUMENTS

Patent Documents

Patent Document 1: JP-A-2008-121085

SUMMARY OF THE INVENTION

Problems that the Invention is to Solve

According to the technology disclosed in the above Patent Document 1, the high-quality granular metallic iron has been able to be produced. However, it has been desired to improve productivity by increasing the yield of the granular metallic iron and shortening the time for producing the granular metallic iron.

The present invention has been made in view of the circumstances as described above, and an object thereof is to provide technology which can improve the productivity of the granular metallic iron.

Means for Solving the Problems

The method for producing granular metallic iron in the present invention which could solve the problems includes agglomerating a mixture including an iron oxide-containing material and a carbonaceous reducing agent, charging a resulting agglomerate onto a hearth of a heating furnace and heating it, thereby reducing iron oxide in the agglomerate, and melting reduced iron by further heating to cause the reduced iron to coalesce, thereby producing granular metallic iron. When the agglomerate is heated on the hearth of the heating furnace, the relationship between a mass ratio (% by mass) of a volatile matter contained in the carbonaceous reducing agent and an average gas flow rate (m/sec) of an atmospheric gas in the heating furnace satisfies the following formula (1):

$$\text{Mass ratio of volatile matter} \leq -4.62 \times \text{average gas flow rate} + 46.7 \quad (1)$$

It is preferred that the value (oxygen amount/fixed carbon amount) obtained by dividing an oxygen amount (% by mass) derived from the iron oxide-containing material included in the agglomerate by a fixed carbon amount (% by mass) derived from the carbonaceous reducing agent included in the agglomerate is from 1.46 to 2.67. The mixture may further contain a melting-point controlling agent.

Advantageous Effects of the Invention

According to the present invention, the relationship between the mass ratio of a volatile matter contained in a carbonaceous reducing agent used as a raw material and the average gas flow rate of an atmospheric gas in a heating furnace is properly controlled, so that the productivity of granular metallic iron can be improved.

MODE FOR CARRYING OUT THE INVENTION

Figure 1:
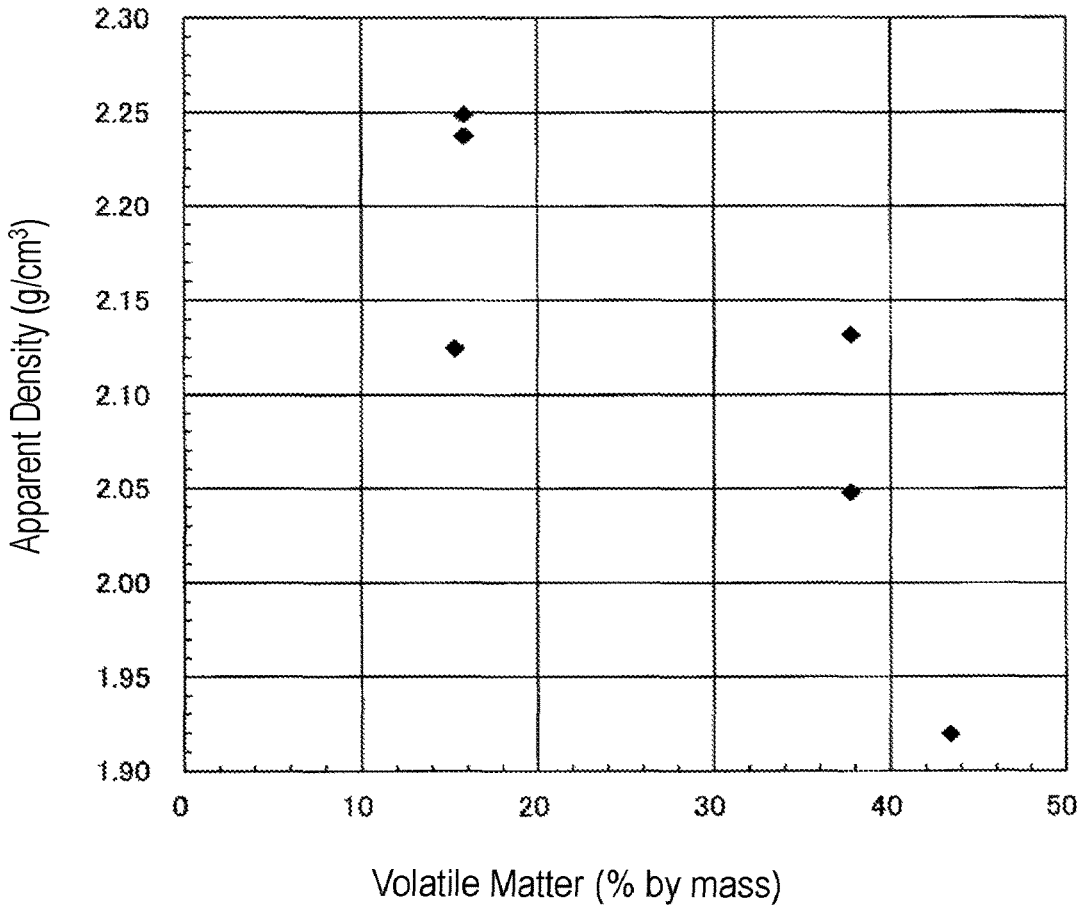
FIG. 1 is a graph showing the relationship between the mass ratio (% by mass) of the volatile matter contained in a carbon material and the apparent density (g/cm$^3$) of dried pellets.

In order to improve the productivity of granular metallic iron, the present inventors have made intensive studies. As a result, it has been found that when the relationship between the mass ratio of the volatile matter contained in a carbonaceous reducing agent used as a raw material and the average gas flow rate of an atmospheric gas in a heating furnace is properly controlled, the productivity of the granular metallic iron can be improved, because the yield of the granular metallic iron can be increased and the time for producing the granular metallic iron can be shortened. Thus, the present invention has been completed.

An agglomerate charged onto a hearth of a heating furnace is heated by gas heat transfer or radiant heat from combustion burners mounted in the furnace, and iron oxide in an iron oxide-containing material included in the agglomerate is reduced with the carbonaceous reducing agent. Then, the reduced iron is carburized with the carbonaceous reducing agent in the agglomerate or the carbonaceous reducing agent placed on the hearth of the heating furnace as a bed material by further heating the reduced iron, melted and caused to coalesce to form the granular metallic iron.

Oxidizing gases such as carbon dioxide gas and water vapor are generated by combustion, because a fossil fuel such as natural gas is generally used as a fuel for the above combustion burners. The above reduced iron is sometimes reoxidized with the oxidizing gases. When the reduced iron is reoxidized, FeO formed makes a transition to the side of slag. Therefore, the FeO concentration in the slag is increased in the melting and agglomeration states. FeO in the slag reacts with carbon contained in molten iron to generate CO gas, as shown below. The higher the FeO concentration in the slag is, the longer the time until the reduced iron melted forms the granular metallic iron becomes, because this reaction is an endothermic reaction. Thus, the productivity of the granular metallic iron is reduced.

$$FeO+C=Fe+CO$$

Further, when the CO gas generated remains in the slag as bubbles, it causes expansion of the slag. The expansion of the slag is called slag foaming, and when the slag foaming occurs, the reduced iron during melting and agglomeration is covered with the slag. Therefore, transfer of heat supplied from the surroundings is blocked. As a result, the time until the reduced iron melted forms the granular metallic iron becomes long to reduce the productivity of the granular metallic iron.

In this way, what is important for improving the productivity of the granular metallic iron is to prevent reoxidation of the reduced iron, and for that purpose, it is important to decrease the oxidation degree of the atmospheric gas in the vicinity of the agglomerate.

In order to decrease the oxidation degree of the atmospheric gas in the vicinity of the agglomerate, it is thought to decrease the flow rate of the atmospheric gas in the vicinity of the agglomerate or to enhance reactivity of a carbon material in the carbonaceous reducing agent included in the agglomerate, thereby increasing the amount of CO gas discharged from the agglomerate. Of these, as a method for enhancing the reactivity of the carbon material in the carbonaceous reducing agent included in the agglomerate, it is thought to use a volatile matter-rich carbon material. In general, the larger the amount of the volatile matter contained in the carbon material is, the lower the crystallinity of fixed carbon contained therein becomes. Therefore, the reactions of the following formula (A) and the following formula (B) easily proceed. For this reason, CO gas is generated, and the oxidation degree of the atmospheric gas in the vicinity of the agglomerate is decreased to suppress the reoxidation of the reduced iron.

$$xC+FeO_x=xCO+Fe \quad (A)$$

$$C+CO_2=2CO \quad (B)$$

However, when the volatile matter contained in the carbonaceous reducing agent is increased, it is necessary to increase the ratio of the carbonaceous reducing agent blended in the agglomerate, in order to secure the fixed carbon amount required for reduction of the iron oxide. Therefore, when the heating time in the heating furnace is constant, the apparent density of the agglomerate is decreased, and the iron amount contained in the agglomerate is decreased. As a result, the productivity of the granular metallic iron is reduced.

Therefore, the present inventors have made studies in order to prevent the reoxidation of the reduced iron to suppress the occurrence of the slag foaming and to shorten the time required for the production of the granular metallic iron, thereby improving the productivity of the granular metallic iron, in reducing the iron oxide, melting the resulting reduced iron and causing it to coalesce. As a result, it has becomes clear that when the agglomerate is heated on the hearth of the heating furnace, it is only necessary that the relationship between the mass ratio (% by mass) of the volatile matter contained in the carbonaceous reducing agent and the average gas flow rate (m/sec) of the atmospheric gas in the heating furnace satisfies the following formula (1).

$$\text{Mass ratio of volatile matter} \leq -4.62 \times \text{average gas flow rate} + 46.7 \quad (1)$$

The present inventors have derived the relationship of the above formula (1) by repetition of various experiments, and as explained in the section of Examples described later, when the mass of the carbonaceous reducing agent is 100%, the case where the relationship between the mass ratio of the volatile matter contained in the carbonaceous reducing agent and the average gas flow rate of the atmospheric gas in the heating furnace does not satisfy the above formula (1) has resulted in a reduction in the productivity. That is, in order to decrease the oxidation degree of the atmospheric gas in the vicinity of the agglomerate during heating the agglomerate, it is thought to increase the mass ratio of the volatile matter contained in the carbonaceous reducing agent, as described above. The increase in the volatile matter originally causes a decrease in the iron portion in the agglomerate and a decrease in the density of the agglomerate, so that it has been thought that the productivity is reduced. However, the time required for the production of the granular metallic iron is shortened as a result. It has therefore been an unexpected fact that the productivity of the granular metallic iron is rather improved.

The relationship of the above formula (1) preferably satisfies the relationship of the following formula (1a), and more preferably satisfies the relationship of the following formula (1b).

$$\text{Mass ratio of volatile matter} \leq -4.62 \times \text{average gas flow rate} + 45.3 \quad (1a)$$

$$\text{Mass ratio of volatile matter} \leq -4.62 \times \text{average gas flow rate} + 43.2 \quad (1b)$$

The lower limit of the above mass ratio of the volatile matter is not particularly limited. According to the production method of the present invention, when the mass of the carbonaceous reducing agent is 100%, for example, the mass ratio of even 10% or more can be used, and the mass ratio of even 20% or more can be used. Further, the above mass ratio of the volatile matter may be 30% or more.

The above mass ratio of the volatile matter contained in the carbonaceous reducing agent may be analyzed based on JIS M8812 (2004).

The above average gas flow rate (m/sec) of the atmospheric gas in the heating furnace can be calculated by dividing the gas flow amount ($m^3$) per unit time (sec) by the furnace cross-sectional area ($m^2$) perpendicular to an advancing direction of the gas and a hearth surface. In an actual machine, the above gas flow amount per unit time (sec) can be calculated, for example, by dividing the total gas amount ($m^3$/sec) per unit time (sec) after combustion, which is determined by combustion calculation from the amount of fuel per unit time (sec) supplied into the furnace and the oxygen-containing gas amount per unit time (sec) supplied for combusting the fuel, by the furnace cross-sectional area ($m^2$) perpendicular to the advancing direction of the gas and the hearth surface.

The above average gas flow rate (m/sec) of the atmospheric gas can be adjusted by a way of firing the combustion burners, an amount of firing, an internal shape of the furnace and the like. The ratio of oxidizing gases such as carbon dioxide gas and water vapor contained in the atmospheric gas may be from 30% to 50% by volume.

In the above agglomerate, the value (oxygen amount/fixed carbon amount) obtained by dividing the oxygen amount (% by mass) derived from the iron oxide-containing material included in the agglomerate by the fixed carbon amount (% by mass) derived from the carbonaceous reducing agent included in the agglomerate is preferably from 1.46 to 2.67. Both the above oxygen amount and the above fixed carbon amount are the values when the mass of the agglomerate is assumed to be 100%.

The above oxygen amount/fixed carbon amount becomes an index for determining the blending amount of the carbonaceous reducing agent. That is, the iron portion contained in iron ore which is a representative example of the iron oxide-containing material occurs as iron oxide such as $Fe_2O_3$ and $Fe_3O_4$ (these are hereinafter collectively indicated as $FeO_x$). On the other hand, coal is suitably used as the carbonaceous reducing agent. For carbon contained in the coal, in addition to one lost as volatile matter when heated, one remains even when heated. The carbon which remains after heating is generally called fixed carbon. Although the volatile carbon has little contribution to the reduction of the iron oxide, the fixed carbon contributes to the reduction of the iron oxide. Therefore, the coal having the larger fixed carbon content is more excellent in coal quality. For this reason, the above oxygen amount/fixed carbon amount indicates how much fixed carbon amount is present with respect to the oxygen amount to be reduced, this means that the smaller this value is, the more sufficiently for the reduction of the iron oxide the fixed carbon is present, and that the larger this value is, the more insufficient with respect to the iron oxide the fixed carbon tends to be.

When the above oxygen amount/fixed carbon amount is below 1.46, inhibition of aggregation of the reduced iron is induced by the carbon which remains after the reduction of the iron oxide, and the yield of the granular metallic iron is decreased to less than 95%. In order to increase the yield of the granular metallic iron to 95% or more, the above oxygen amount/fixed carbon amount is preferably 1.46 or more. The above oxygen amount/fixed carbon amount is more preferably 1.50 or more, and still more preferably 1.60 or more.

However, when the above oxygen amount/fixed carbon amount exceeds 2.67, the production amount of the granular metallic iron is decreased, because all the iron oxide cannot be reduced, and the yield of the granular metallic iron is decreased to less than 95%. The value of 2.67 is a theoretical value obtained by determining the fixed carbon by calculation, which is necessary for reducing without excess or deficiency the iron oxide in the iron oxide-containing material included in the agglomerate. In the present invention, the above oxygen amount/fixed carbon amount is preferably 2.67 or less, more preferably 2.50 or less, and still more preferably 2.00 or less.

The above oxygen amount in the iron oxide-containing material included in the agglomerate can be calculated by the following procedure.

First, the total iron (T. Fe) and the FeO amount in the agglomerate are determined by chemical analysis.

Next, assuming that of the T. Fe, Fe which is not present as FeO is all present as $Fe_2O_3$, the mass ($W_{Fe2O3}$) of $Fe_2O_3$ contained in the agglomerate is calculated by the following formula (i). In the following formula (i), $W_x$ indicates the mass (% by mass) of component X, and $M_x$ indicates the molecular weight of component X, respectively. Specifically, $W_{T.\,Fe}$ is the mass (% by mass) of the T. Fe, $W_{FeO}$ is the mass (% by mass) of FeO, $W_{Fe2O3}$ is the mass (% by mass) of $Fe_2O_3$, $M_{Fe}$ is the molecular weight of Fe and is 55.85, $M_{FeO}$ is the molecular weight of FeO and is 71.85, and $M_{Fe2O3}$ is the molecular weight of $Fe_2O_3$ and is 159.7.

[Mathematical Formula 1]

$$W_{Fe2O3} = [\{W_{T.\,Fe} - W_{FeO} \times (M_{Fe}/M_{FeO})\}/2M_{Fe}] \times M_{Fe2O3} \quad (i)$$

Then, based on the following formula (ii), the oxygen amount in the iron oxide-containing material included in the agglomerate is calculated as the total of the oxygen amount contained in $Fe_2O_3$ and the oxygen amount contained in FeO. In the formula, $M_O$ is the atomic weight of oxygen and 16.

[Mathematical Formula 2]

$$\text{Oxygen amount} = \{(W_{Fe2O3}/M_{Fe2O3}) \times 3 + (W_{FeO}/M_{FeO})\} \times M_o \quad (ii)$$

Next, the method for producing granular metallic iron according to the present invention will be described.

In the method for producing granular metallic iron according to the present invention, a mixture including an iron oxide-containing material and a carbonaceous reducing agent is agglomerated (hereinafter sometimes referred to as an agglomerating step), and a resulting agglomerate is charged onto a hearth of a heating furnace and heated, thereby reducing iron oxide in the agglomerate, and reduced iron is melted by further heating to cause the reduced iron to coalesce (hereinafter sometimes referred to as a heating step), thereby producing granular metallic iron. Then, in the present invention, when the above agglomerate is heated on the hearth of the above heating furnace, the relationship between the mass ratio (% by mass) of the volatile matter contained in the above carbonaceous reducing agent and the average gas flow rate (m/sec) of the atmospheric gas in the above heating furnace satisfies the above formula (1), as described above. Since the relationship of the above formula (1) has been described above in detail, the other parts will be described below.

[Agglomerating Step]

In the agglomerating step, the mixture including the iron oxide-containing material and the carbonaceous reducing agent is agglomerated to produce the agglomerate. As the above iron oxide-containing material, there can be used, specifically, an iron oxide source such as iron ore, iron sand, iron-making dust, a nonferrous refining residue or an iron-making waste. As the above carbonaceous reducing agent, a carbon-containing reducing agent can be used, and examples thereof include coal, coke and the like.

A melting-point controlling agent may be further blended in the above mixture. The above melting-point controlling agent means a substance having an action of decreasing the melting point of gangue in the iron oxide-containing material or ash in the carbonaceous reducing agent. That is, blending of the melting-point controlling agent in the above mixture has an influence on the melting point of components other than the iron oxide contained in the agglomerate, particularly the gangue, and for example, the melting point thereof can be decreased. Melting of the gangue is accelerated thereby to form molten slag. At this time, a part of the iron oxide is melted in the molten slag, and reduced in the molten slag. Reduced iron produced in the molten slag comes into contact with reduced iron reduced in a solid state, thereby causing the reduced iron to coalesce as solid reduced iron.

As the above melting-point controlling agent, there can be used, for example, a CaO supplying material, a MgO supplying material, an $Al_2O_3$ supplying material, a $SiO_2$ supplying material, fluorite ($CaF_2$) or the like. As the above CaO supplying material, there can be used, for example, at least one selected from the group consisting of CaO (calcined lime), $Ca(OH)_2$ (hydrated lime), $CaCO_3$ (limestone) and $CaMg(CO_3)_2$ (dolomite). As the above MgO supplying material, there may be blended, for example, at least one selected from the group consisting of a MgO powder, a Mg-containing material extracted from natural ore, sea water or the like and $MgCO_3$. As the above $Al_2O_3$ supplying material, there can be blended, for example, $Al_2O_3$ powder, bauxite, boehmite, gibbsite, diaspore or the like. As the above $SiO_2$ supplying material, for example, $SiO_2$ powder, silica sand or the like can be used.

A binder may be further blended in the above mixture. As the above binder, for example, an organic binder, an inorganic binder or the like can be used. As the organic binder, for example, a polysaccharide can be used. As the polysaccharide, for example, starch such as cornstarch or flour, or the like can be used. As the inorganic binder, hydrated lime, bentonite or the like can be used.

It is preferred that the above iron oxide-containing material, carbonaceous reducing agent and melting-point controlling agent are previously pulverized before mixing. For example, it is recommended to pulverize the above iron oxide-containing material to have an average particle diameter of 10 to 60 μm, to pulverize the above carbonaceous reducing agent to have an average particle diameter of 10 to 60 μm, and to pulverize the above melting-point controlling agent to have an average particle diameter of 5 to 90 μm.

A means for performing the above pulverization is not particularly limited, and a known means can be employed. For example, a vibration mill, a roll crusher, a ball mill or the like can be used.

The iron oxide-containing material and the like described above may be mixed using a rotary container type mixer or a stationary container type mixer. As the rotary container type mixers, examples thereof include but are not limited to, for example, rotary cylinder type, double conical type and V-shaped mixers. As the stationary container type mixers, examples thereof include but are not limited to, for example, a mixer in which, for example, a rotary blade such as a spade is provided in a mixing tank.

Next, the mixture obtained by the above mixer is agglomerated to produce the agglomerate. The shape of the above agglomerate is not particularly limited, and for example, may be pellet-like, briquette-like or the like. Although the size of the above agglomerate is also not particularly limited, the particle diameter is preferably 50 mm or less. When the particle diameter of the agglomerate is excessively increased, the granulation efficiency is deteriorated. Further, when the agglomerate is too large, heat transfer to a lower part of the agglomerate is deteriorated to reduce the productivity. The lower limit of the particle diameter of the agglomerate is about 5 mm.

As an agglomerating machine for agglomerating the above mixture, there can be used, for example, a dish granulator, a cylindrical granulator, a twin roll type briquette molding machine, an extruder or the like. The dish granulator is sometimes called a disk granulator. Further, the cylindrical granulator is sometimes called a drum granulator.

[Heating Step]

In the heating step, the agglomerate obtained in the above agglomerating step is charged onto the hearth of the heating furnace and heated, thereby reducing the iron oxide in the agglomerate, and the reduced iron is melted by further heating to cause the reduced iron to coalesce, thereby producing the granular metallic iron.

As the above heating furnaces, examples thereof include an electric furnace and a movable hearth furnace. The above movable hearth furnace is a heating furnace in which a hearth moves like a belt conveyor in the furnace, and examples thereof include a rotary hearth furnace and a tunnel furnace. In the above rotary hearth furnace, the appearance shape of the hearth is designed into a circular form or a doughnut form so that a starting point and an end point at the hearth are arranged at the same position, and the iron oxide contained in the agglomerate charged onto the hearth is heated and reduced while making one round in the furnace to produce the reduced iron. Therefore, the rotary hearth furnace is provided with a charging means for charging the agglomerate into the furnace on the most upstream side in the rotational direction and provided with a discharge means on the most downstream side in the rotational direction. The hearth of the rotary hearth furnace has a rotational structure, so that the most downstream side in the rotational direction is actually the just upstream side of the charging means. The above tunnel furnace is a heating furnace in which a hearth moves in the linear direction in the furnace.

In the present invention, the above reduced iron formed in the above heating furnace is all once melted in the above heating furnace.

The above agglomerate is preferably heated and reduced by heating at 1350 to 1500° C. on the hearth. When the above heating temperature is below 1350° C., the reduced iron and the slag are difficult to be melted, sometimes resulting in a failure to obtain high productivity. Therefore, the above heating temperature is preferably 1350° C. or higher and more preferably 1400° C. or higher. However, when the above heating temperature exceeds 1500° C., an exhaust gas treatment equipment becomes large-scale to increase equipment cost, because the exhaust gas temperature is increased. Therefore, the above heating temperature is preferably 1500° C. or lower and more preferably 1480° C. or lower.

Prior to charging the above agglomerate into the above heating furnace, the bed material is desirably placed for hearth protection.

As the above bed material, there can be used, for example, refractory particles such as a refractory ceramic, as well as one exemplified as the above carbonaceous reducing agent.

The upper limit of the particle diameter of the above bed material is preferably such a particle diameter that the agglomerate or its melt does not get thereinto. The lower limit of the particle diameter of the above bed material is preferably such a shape that the bed material is not blown off by the combustion gas of the burners.

[Others]

The granular metallic iron obtained in the above heating step is separated into the granular metallic iron and the slag, and the granular metallic iron may be recovered. The recovered granular metallic iron can be used as an iron source, for example, in a blast furnace, a converter, an electric furnace or the like.

The present invention is described in greater detail below by way of examples. However, the present invention should not be limited by the following examples, and it is of course possible to make variations without departing from the scope of the present invention as described above and below, all these falling within the technical scope of the invention.

EXAMPLES

In the following Experimental Example 1 and Experimental Example 2, a mixture including an iron oxide-containing material and a carbonaceous reducing agent was agglomerated, a resulting agglomerate was charged into a heating furnace and heated, thereby reducing iron oxide in the agglomerate, and reduced iron was melted by further heating to cause the reduced iron to coalesce, thereby producing granular metallic iron. At this time, in the following Experimental Example 1, an effect of the relationship between the mass ratio (% by mass) of the volatile matter contained in the carbonaceous reducing agent and the average gas flow rate (m/sec) of the atmospheric gas in the heating furnace on the productivity of the granular metallic iron was examined. On the other hand, in the following Experimental Example 2, an effect of the value (oxygen amount/fixed carbon amount) obtained by dividing the oxygen amount (% by mass) derived from the iron oxide-containing material included in the agglomerate by the fixed carbon amount (% by mass) derived from the carbonaceous reducing agent included in the agglomerate on the yield of the granular metallic iron was examined. In the following Experimental Examples 1 and 2, pellets were used as the agglomerate.

Experimental Example 1

As the above iron oxide-containing material, iron ore α having a component composition shown in the following Table 1 was used. In the following Table 1, the T. Fe means the total iron. Further, in the following Table 1, the calculation results of the oxygen amount in FeO contained in the iron ore α and the oxygen amount in $Fe_2O_3$ contained in the iron ore α are also shown. Further, when FeO and $Fe_2O_3$ contained in the iron ore α are indicated as $FeO_x$, the oxygen amount in $FeO_x$ contained in the iron ore α is also shown in the following Table 1.

As the above carbonaceous reducing agent, carbon materials a to d having component compositions shown in the following Table 2 were each used. In the following Table 2, the T. C means the total carbon.

A melting-point controlling agent and a binder were mixed in the above iron ore and the above carbon material, and a moderate amount of water was further blended therein. A mixture thus obtained was granulated using a tire type granulator to form green pellets having a diameter of 19 mm.

The resulting green pellets were charged into a dryer, and attached water was removed to produce spherical dry pellets. The component compositions of the resulting dry pellets are shown in the following Table 3. "Others" shown in the following Table 3 are the melting-point controlling agent and the binder. As the binder, an organic binder represented by flour was used.

When the mass of the dry pellets was 100%, the oxygen amount in the iron ore contained in the dry pellets and the fixed carbon amount in the carbon material contained in the dry pellets were calculated, and the results thereof are shown in the following Table 3. Further, the value (oxygen amount/fixed carbon amount) obtained by dividing the above oxygen amount (% by mass) by the above fixed carbon amount (% by mass) was calculated, and the results thereof are shown in the following Table 3.

Here, taking dry pellets A shown in the following Table 3, a procedure for calculating the value of oxygen amount/fixed carbon amount is explained.

(Oxygen Amount)

As shown in the following Table 3, the iron ore amount contained in the dry pellets A is 71.34%, and the oxygen amount in $FeO_x$ contained in the iron ore is 27.67% from the following Table 1. Therefore, when the mass of the dry pellets A is 100%, the oxygen amount in the iron ore contained in the dry pellets A is 19.74%.

$$(71.34\times27.67)/100=19.74$$

(Fixed Carbon Amount)

As shown in the following Table 3, the carbon material amount contained in the dry pellets A is 16.27%, and the fixed carbon amount contained in the carbon material is 78.00% from the following Table 2. Therefore, when the mass of the dry pellets A is 100%, the fixed carbon amount in the carbon material contained in the dry pellets A is 12.69%.

$$(16.27\times78.00)/100=12.69$$

Accordingly, the value (oxygen amount/fixed carbon amount) obtained by dividing the oxygen amount in the iron ore contained in the dry pellets A by the fixed carbon amount in the carbon material contained in the dry pellets A is 1.56.

Further, the apparent density ρ ($g/cm^3$) of the dry pellets and the amount (% by mass) of the total iron (T. Fe) contained in the dry pellets were measured, and the results thereof are shown in the following Table 4. The kind of the dry pellets, the kind of the carbon material used in producing the dry pellets and mass ratio of the volatile matter contained in the carbon material when the mass of the carbon material is 100% are shown in the following Table 4. The mass ratio of the volatile matter is the same as the value sown in the following Table 2.

Here, the relationship between the mass ratio (% by mass) of the volatile matter contained the carbon material and the apparent density ($g/cm^3$) of the dry pellets is shown in FIG. 1.

Figure 2:
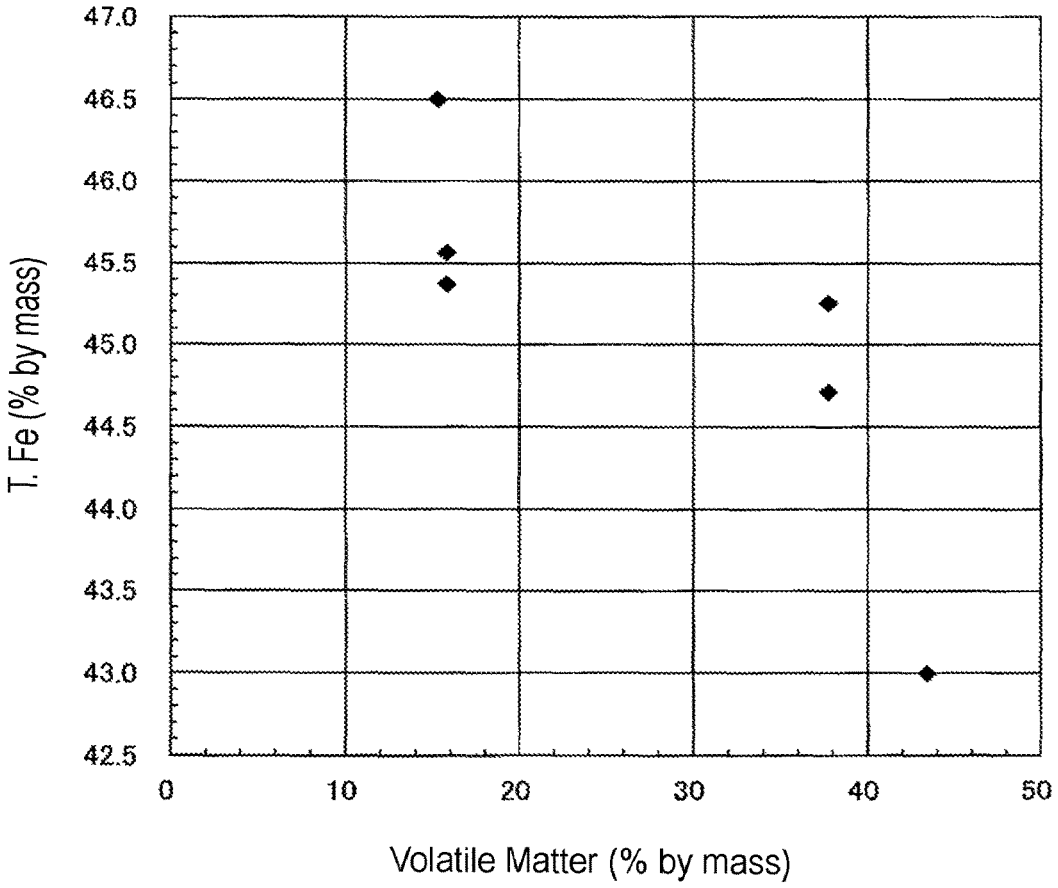
FIG. 2 is a graph showing the relationship between the mass ratio (% by mass) of the volatile matter contained in a carbon material and the amount (% by mass) of total iron contained in dried pellets.

Further, the relationship between the mass ratio (% by mass) of the volatile matter contained in the carbon material and the amount (% by mass) of the total iron contained in the dry pellets is shown in FIG. 2.

Then, the resulting dry pellets were charged onto a hearth of the heating furnace and heated at 1450° C. to reduce the iron oxide in the dry pellets, and the reduced iron was melted by further heating to cause the reduced iron to coalesce, thereby producing the granular metallic iron. As the above heating furnace, an electric furnace was used. Prior to charging the dry pellets, a carbon-containing solid material, for example, graphite powder or the like was placed on the hearth of the above electric furnace for hearth protection.

When the above dry pellets were heated on the hearth of the above electric furnace, the composition of the atmospheric gas in the electric furnace was made to a mixed gas atmosphere of carbon dioxide gas and nitrogen gas, simulating the gas composition at the time when natural gas was completely combusted, and the average gas flow rate (m/sec) in the electric furnace was controlled. The above average gas flow rate was defined as the value calculated by converting the gas flow amount per unit time ($m^3$/sec) adjusted by a flow meter to the gas flow amount per unit time ($m^3$/sec) based on the temperature in the electric furnace and dividing this gas flow amount by the cross-sectional area ($m^2$) of a flow passage. The cross-section of the flow passage means a cross-section perpendicular to an advancing direction of the gas and perpendicular to a hearth surface. The calculated average gas flow rate (m/sec) in the electric furnace is shown in the following Table 4. Further, the average gas flow rate was substituted into the right side of the above formula (1), and the value of the right side was calculated. The calculated value of the right side is hereinafter called the Z value, and the Z value is shown in the following Table 4.

$$Z=-4.62\times\text{average gas flow rate}+46.7$$

Further, the time (min) necessary for reduction melting of the above dry pellets was measured. The measurement results are shown in the following Table 4. In the following Table 4, it is indicated as the reaction time (min).

Figure 3:
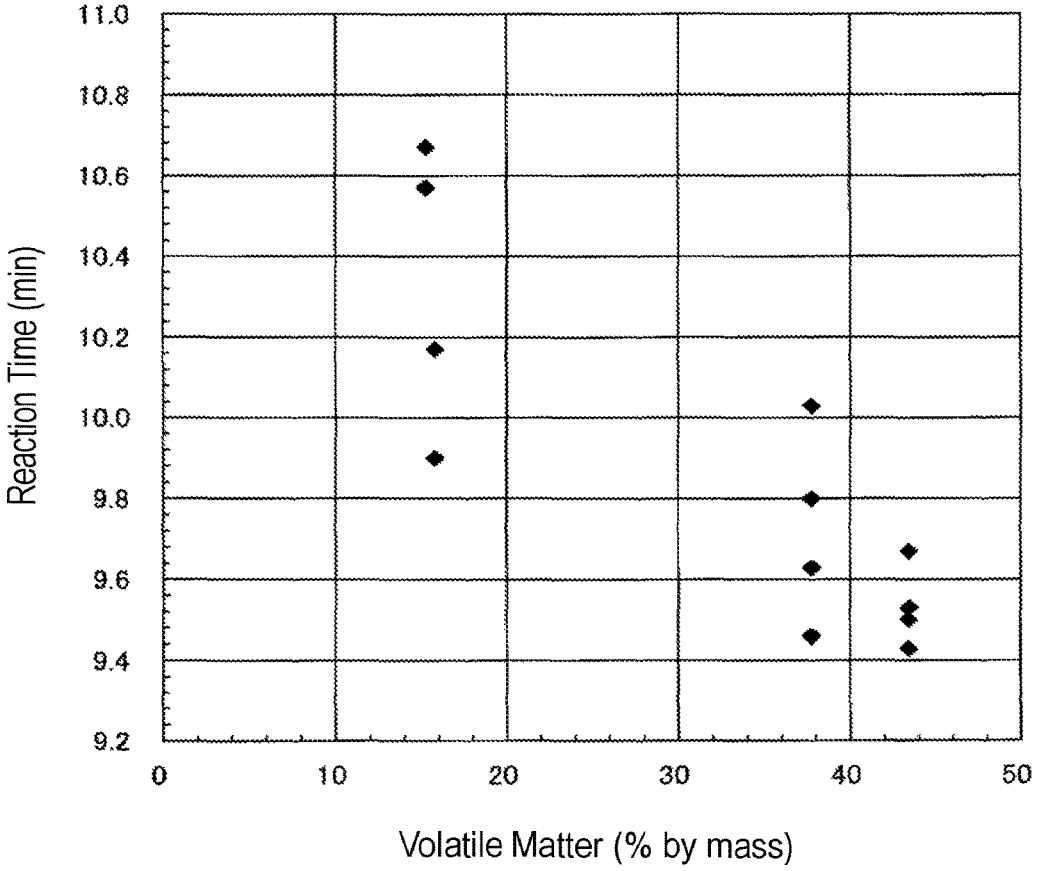
FIG. 3 is a graph showing the relationship between the mass ratio (% by mass) of the volatile matter contained in a carbon material and the reaction time (min).

Here, the relationship between the mass ratio (% by mass) of the volatile matter contained in the carbon material and the reaction time (min) is shown in FIG. 3.

Then, after the completion of reduction, a sample containing the granular metallic iron was discharged from the electric furnace.

The resulting sample was subjected to magnetic separation, and magnetically attractable substances were classified using a sieve having an opening of 3.35 mm. Residues left on the sieve were recovered as a product. The residues recovered as the product were mainly the granular metallic iron, and the mass thereof was measured. Based on the mass (g) of the granular metallic iron and the mass (g) of the T. Fe contained in the dry pellets, the yield (%) of the granular metallic iron was calculated, and the results thereof are shown in the following Table 4. The granular metallic iron contains C and the like, as well as Fe, so that the yield sometimes exceeds 100%.

$$\text{Yield (\%)}=(\text{the mass of the granular metallic iron/the mass of the T. Fe contained in the dry pellets})\times 10$$

Here, based on the apparent density of the dry pellets, the amount of the total iron contained in the dry pellets, the time necessary for reduction melting of the dry pellets (hereinafter sometimes referred to as the reaction time) and the yield of the granular metallic iron shown in the following Table 4, the productivity of the granular metallic iron was calculated by the following formula. The calculation results thereof are shown in the following Table 4.

$$\text{Productivity}=(A\times B\times D)/C$$

wherein A to D are as follows:

A=the apparent density ($g/cm^3$) of the dry pellets

B=the amount (% by mass) of the total iron contained in the dry pellets

C=the time (min) necessary for reduction melting of the dry pellets

D=the yield (%) of the granular metallic iron

Further, assuming the productivity in No. 1 shown in the following Table 4 as a standard value 1.00, the relative values of the productivity in Nos. 2 to 15 were calculated as productivity indexes, and the results thereof are shown in the following Table 4.

Figure 4:
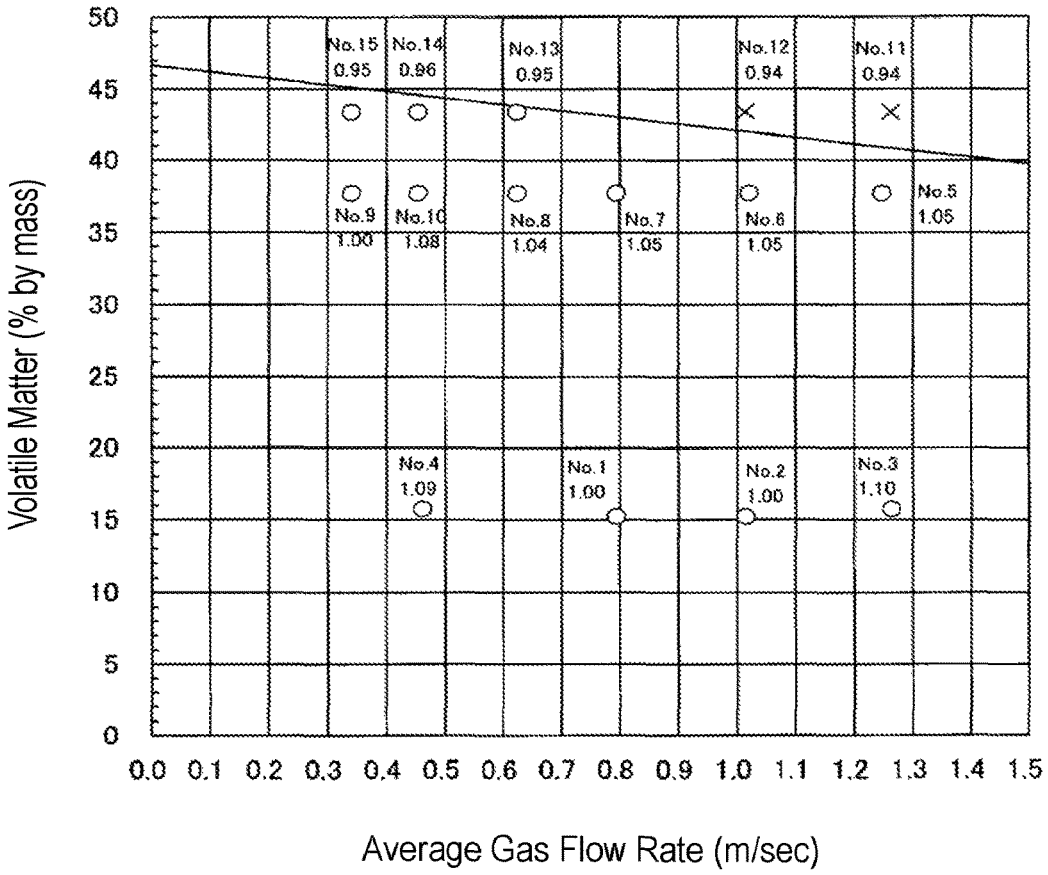
FIG. 4 is a graph showing the relationship between the average gas flow rate (m/sec) in an electric furnace and the mass ratio (% by mass) of the volatile matter in a carbonaceous reducing agent contained in dried pellets.

Furthermore, the relationship between the average gas flow rate (m/sec) in the electric furnace shown in the following Table 4 and the mass ratio (% by mass) of the volatile matter in the carbonaceous reducing agent contained in the dry pellets is shown in FIG. 4. The circles shown in FIG. 4 indicate the results of Nos. 1 to 10 and 13 to 15 shown in the following Table 4, and the crosses indicate the results of Nos. 11 and 12 shown in the following Table 4. The numerical value described near each plot point indicates the productivity index shown in the following Table 4.

From the following Table 3, Table 4 and FIG. 4, the following observations can be made. Nos. 11 and 12 are examples not satisfying the requirements specified in the present invention. That is, the relationship between the mass ratio of the volatile matter contained in the carbon material and the average gas flow rate of the atmospheric gas in the heating furnace does not satisfy the above formula (1). Therefore, the productivity could not be improved. In contrast, Nos. 1 to 10 and Nos. 13 to 15 are examples satisfying the requirements specified in the present invention. That is, the relationship between the mass ratio of the volatile matter contained in the carbon material and the average gas flow rate of the atmospheric gas in the heating furnace satisfies the above formula (1). Therefore, the productivity could be improved. Further, the value (oxygen amount/fixed carbon amount) obtained by dividing the oxygen amount in the iron ore contained in the dry pellets by the fixed carbon amount in the carbon material contained in the dry pellets satisfies the range of 1.46 to 2.67, so that the yield of the granular metallic iron is increased.

TABLE 1

| Iron | Component Composition (% by mass) | | | Oxygen Amount (% by mass) | | |
|---|---|---|---|---|---|---|
| Ore | T. Fe | FeO | $Fe_2O_3$ | In FeO | In $Fe_2O_3$ | In $FeO_x$ |
| α | 65.18 | 3.10 | 89.75 | 0.69 | 26.98 | 27.67 |

TABLE 2

| Carbon | Component Composition (% by mass) | | |
|---|---|---|---|
| Material | Fixed Carbon | Volatile Matter | T. C |
| a | 78.00 | 15.25 | 86.87 |
| b | 77.51 | 15.77 | 87.59 |
| c | 54.97 | 37.74 | 78.14 |
| d | 50.00 | 43.40 | 69.46 |

TABLE 3

| Dry Pellets | Component Composition (% by mass) Iron Ore | Carbon Material Kind | Carbon Material Amount | Others | Oxygen Amount (% by mass) | Fixed Carbon Amount (% by mass) | Oxygen Amount/ Fixed Carbon Amount |
|---|---|---|---|---|---|---|---|
| A | 71.34 | a | 16.27 | 12.39 | 19.74 | 12.69 | 1.56 |
| B | 69.91 | b | 17.06 | 13.04 | 19.34 | 13.22 | 1.46 |
| C | 69.61 | b | 17.06 | 12.98 | 19.26 | 13.22 | 1.46 |
| D | 69.43 | c | 18.82 | 11.76 | 19.21 | 10.35 | 1.86 |
| E | 68.60 | c | 19.34 | 12.07 | 18.98 | 10.63 | 1.79 |
| F | 65.97 | d | 21.23 | 12.81 | 18.25 | 10.62 | 1.72 |

TABLE 4

| No. | Dry Pellets | Carbon Material Kind | Carbon Material Volatile Matter | Density ρ (g/cm$^3$) | T. Fe (% by mass) | Average Gas Flow Rate (m/sec) | Z Value | Reaction Time (min) | Yield (%) | Productivity | Productivity Index |
|---|---|---|---|---|---|---|---|---|---|---|---|
| 1 | A | a | 15.25 | 2.125 | 46.50 | 0.793 | 43.04 | 10.67 | 99.24 | 918.9 | 1.00 |
| 2 | A | a | 15.25 | 2.125 | 46.50 | 1.014 | 42.02 | 10.57 | 98.53 | 921.0 | 1.00 |
| 3 | B | b | 15.77 | 2.237 | 45.57 | 1.262 | 40.87 | 9.90 | 98.53 | 1014.5 | 1.10 |
| 4 | C | b | 15.77 | 2.249 | 45.37 | 0.460 | 44.57 | 10.17 | 100.10 | 1004.2 | 1.09 |
| 5 | D | c | 37.74 | 2.048 | 45.25 | 1.246 | 40.94 | 9.46 | 98.88 | 968.7 | 1.05 |
| 6 | D | c | 37.74 | 2.048 | 45.25 | 1.020 | 41.99 | 9.63 | 100.27 | 965.0 | 1.05 |
| 7 | D | c | 37.74 | 2.048 | 45.25 | 0.793 | 43.04 | 9.63 | 100.63 | 968.5 | 1.05 |
| 8 | D | c | 37.74 | 2.048 | 45.25 | 0.623 | 43.82 | 9.80 | 100.65 | 951.9 | 1.04 |
| 9 | D | c | 37.74 | 2.048 | 45.25 | 0.340 | 45.13 | 10.03 | 99.81 | 922.3 | 1.00 |
| 10 | E | c | 37.74 | 2.132 | 44.71 | 0.453 | 44.61 | 9.63 | 100.63 | 996.2 | 1.08 |
| 11 | F | d | 43.40 | 1.920 | 43.00 | 1.262 | 40.87 | 9.43 | 98.83 | 865.1 | 0.94 |
| 12 | F | d | 43.40 | 1.920 | 43.00 | 1.014 | 42.02 | 9.53 | 100.20 | 867.9 | 0.94 |
| 13 | F | d | 43.40 | 1.920 | 43.00 | 0.623 | 43.82 | 9.67 | 102.20 | 872.4 | 0.95 |
| 14 | F | d | 43.40 | 1.920 | 43.00 | 0.453 | 44.61 | 9.50 | 101.74 | 884.0 | 0.96 |
| 15 | F | d | 43.40 | 1.920 | 43.00 | 0.340 | 45.13 | 9.53 | 101.21 | 876.6 | 0.95 |

$Z = -4.62 \times$ average gas flow rate $+ 46.7$

Experimental Example 2

As the above iron oxide-containing material, iron ore α having a component composition shown in the above Table 1 was used. As the above carbonaceous reducing agent, carbon materials a to d having component compositions shown in the above Table 2 were each used. A melting-point controlling agent and a binder were mixed in the above iron ore and the above carbon material, and a moderate amount of water was further blended therein. A mixture thus obtained was granulated in the same procedure as in the above Experimental Example 1 to form green pellets having an average diameter of 19 mm.

The resulting green pellets were charged into a dryer, and dried under the same conditions as in the above Experimental Example 1 to produce spherical dry pellets. The component compositions of the resulting dry pellets are shown in the following Table 5. "Others" shown in the following Table 5 are the melting-point controlling agent and the binder. The oxygen amount in the iron ore contained in the dry pellets and the fixed carbon amount in the carbon material contained in the dry pellets were calculated, and the results thereof are shown in the following Table 5. Further, the value (oxygen amount/fixed carbon amount) obtained by dividing the above oxygen amount by the above fixed carbon amount was calculated, and the results thereof are shown in the following Table 5.

Then, the resulting dry pellets were charged onto a hearth of the heating furnace and heated at 1450° C. under the same conditions as in the above Experimental Example 1 to reduce the iron oxide in the dry pellets, and the reduced iron was melted by further heating to cause the reduced iron to coalesce, thereby producing the granular metallic iron.

When the above dry pellets were heated on the hearth of the above electric furnace, the composition of the atmospheric gas in the electric furnace was made to a mixed gas atmosphere of carbon dioxide gas and nitrogen gas, simulating the gas composition at the time when natural gas was completely combusted, and the average gas flow rate (m/sec) in the electric furnace was controlled. The above average gas flow rate was defined as the value calculated by converting the gas flow amount per unit time (m$^3$/sec) adjusted by a flow meter to the gas flow amount per unit time (m$^3$/sec) based on the temperature in the electric furnace and dividing this gas flow amount by the cross-sectional area (m$^2$) of a flow passage. The calculated average gas flow rate (m/sec) in the electric furnace is shown in the following Table 5.

Then, after the completion of reduction, a sample containing the granular metallic iron was discharged from the electric furnace, and the yield (%) of the granular metallic iron was calculated under the same conditions as in the above Experimental Example 1. The results thereof are shown in the following Table 5.

Figure 5:
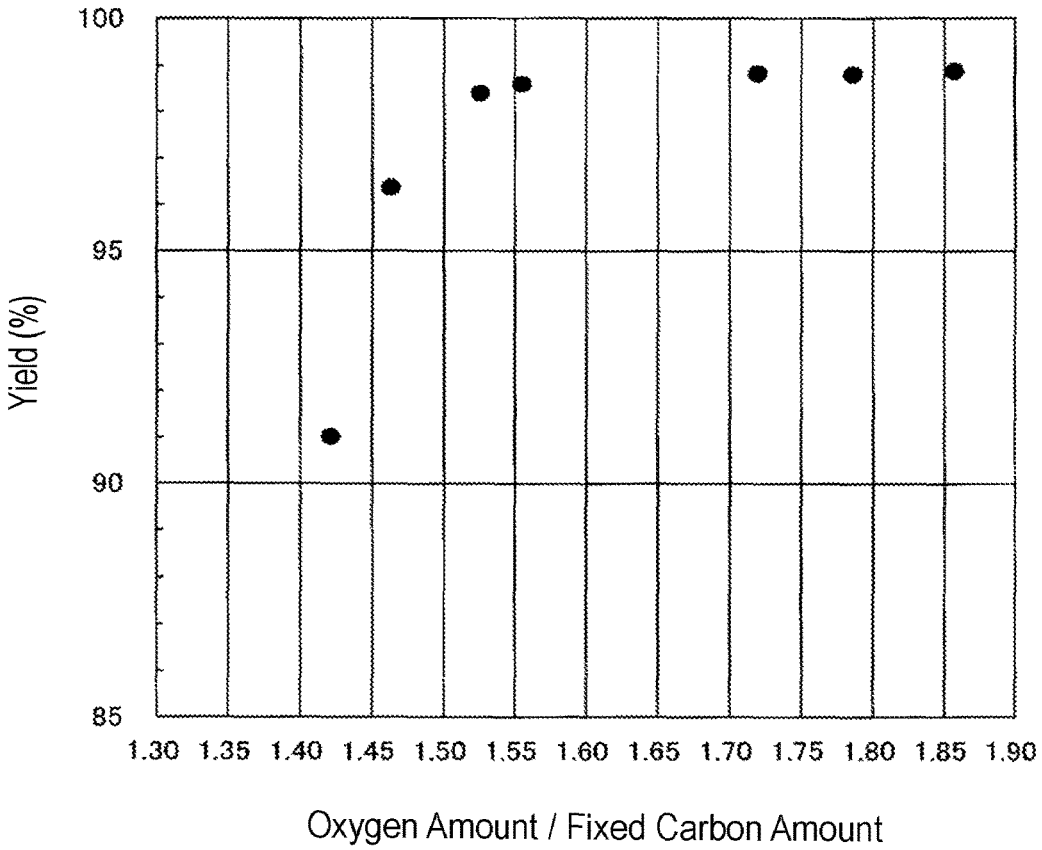
FIG. 5 is a graph showing the relationship between the value (oxygen amount/fixed carbon amount) obtained by dividing the oxygen amount by the fixed carbon amount and the yield (%) of granular metallic iron.

Further, the relationship between the value (oxygen amount/fixed carbon amount) obtained by dividing the oxygen amount shown in the following Table 5 by the fixed carbon amount and the yield (%) of the granular metallic iron is shown in FIG. 5.

Based on the following Table 5 and FIG. 5, the following observations can be made. It can be read that the yield of the granular metallic iron tends to be increased by increasing the above value of oxygen amount/fixed carbon amount, and it is known that when the value of oxygen amount/fixed carbon amount is increased to 1.46 or more, the yield of the granular metallic iron can be increased to 95% or more.

TABLE 5

| No. | Dry Pellet | Component Composition (% by mass) Iron Ore | Carbon Material Kind | Carbon Material Amount | Others | Oxygen Amount (% by mass) | Fixed Carbon Amount (% by mass) | Oxygen Amount/Fixed Carbon Amount | Average Gas Flow Rate (m/sec) | Yield (%) |
|---|---|---|---|---|---|---|---|---|---|---|
| 21 | A | 71.34 | a | 16.27 | 12.39 | 19.74 | 12.69 | 1.55 | 1.262 | 98.60 |
| 22 | B | 69.91 | b | 17.06 | 13.04 | 19.34 | 13.22 | 1.46 | 1.262 | 96.38 |
| 23 | C | 70.33 | b | 16.46 | 13.22 | 19.46 | 12.76 | 1.53 | 1.262 | 98.40 |
| 24 | D | 69.30 | b | 17.41 | 13.30 | 19.17 | 13.49 | 1.42 | 1.262 | 91.02 |
| 25 | E | 69.43 | c | 18.82 | 11.76 | 19.21 | 10.34 | 1.86 | 1.262 | 98.88 |
| 26 | F | 68.60 | c | 19.34 | 12.07 | 18.98 | 10.63 | 1.79 | 1.262 | 98.81 |
| 27 | G | 65.97 | d | 21.23 | 12.81 | 18.25 | 10.62 | 1.72 | 1.262 | 98.83 |

Although the present invention has been described in detail with reference to the specific embodiments, it will be apparent to those skilled in the art that various changes and modifications can be made without departing from the spirit and scope of the present invention.

This application is based on Japanese Patent Application No. 2014-101724 filed on May 15, 2014, the contents of which are incorporated herein by reference.

INDUSTRIAL APPLICABILITY

According to the iron-making process of the present invention using iron ore as a raw material, granular metallic iron can be efficiently produced.

The invention claimed is:

1. A method for producing granular metallic iron, the method comprising:

agglomerating a mixture comprising an iron oxide-containing material and a carbonaceous reducing agent to obtain an agglomerate;

charging the agglomerate onto a hearth of a heating furnace and heating it, thereby reducing iron oxide in the agglomerate to obtain reduced iron; and melting the reduced iron by further heating to cause the reduced iron to coalesce, thereby producing the granular metallic iron, wherein, when the agglomerate is heated on the hearth of the heating furnace, an average gas flow rate of an atmospheric gas in the heating furnace is 0.340 in/sec or more, and a relationship between a mass ratio (%) by mass) of a volatile matter contained in the carbonaceous reducing agent and the average gas flow rate (m/sec) satisfies formula (1):

$$\text{Mass ratio of volatile matter} \leq -4.62 \times \text{average gas flow rate} + 46.7 \quad (1).$$

2. The method according to claim 1, wherein an oxygen amount/fixed carbon amount ratio is from 1.46 to 2.67, where the oxygen amount represents an amount of oxygen by mass percentage derived from the iron oxide-containing material and the fixed carbon amount represents an amount of fixed carbon by mass percentage derived from the carbonaceous reducing agent.

3. The method according to claim 1, wherein the mixture further comprises a melting-point controlling agent.

4. The method according to claim 2, wherein the mixture further comprises a melting-point controlling agent.

* * * * *